US010624389B1

(12) United States Patent
Salgado

(10) Patent No.: US 10,624,389 B1
(45) Date of Patent: Apr. 21, 2020

(54) COMBINATION STORAGE CONTAINER, SCALE, AND ROLLING PAPER DISPENSER

(71) Applicant: Manuel Salgado, Fresno, CA (US)

(72) Inventor: Manuel Salgado, Fresno, CA (US)

( * ) Notice: Subject to any disclaimer, the term of this patent is extended or adjusted under 35 U.S.C. 154(b) by 0 days.

(21) Appl. No.: 15/660,884

(22) Filed: Jul. 26, 2017

(51) Int. Cl.

| | |
|---|---|
| ***B65G 59/00*** | (2006.01) |
| ***B65H 1/00*** | (2006.01) |
| ***A24F 23/00*** | (2006.01) |
| ***A24F 17/00*** | (2006.01) |
| ***A24B 13/00*** | (2006.01) |
| *B65B 7/16* | (2006.01) |

(52) U.S. Cl.
CPC ..... *A24F 23/00* (2013.01); *A24B 13/00* (2013.01); *A24F 17/00* (2013.01); *B65B 7/16* (2013.01)

(58) Field of Classification Search
CPC ..... A24F 23/00; A24F 17/00; A24B 13/00; B65B 7/16
USPC ..... 221/92
See application file for complete search history.

(56) References Cited

U.S. PATENT DOCUMENTS

| | | | | |
|---|---|---|---|---|
| 2,961,108 | A * | 11/1960 | Johnson | B65D 51/24 206/459.5 |
| 3,410,635 | A * | 11/1968 | Lockwood | G02B 21/0008 359/804 |
| D244,085 | S * | 4/1977 | Giddings | D9/432 |
| D291,970 | S | 9/1987 | Downing et al. | |
| 6,386,367 | B1 * | 5/2002 | Bayliss, IV | A61J 1/03 206/459.5 |
| 6,781,068 | B2 * | 8/2004 | Zahriya | G01G 7/06 177/127 |
| D517,437 | S * | 3/2006 | Barmes | D10/91 |
| D517,935 | S * | 3/2006 | Barmes | D10/91 |
| D524,180 | S * | 7/2006 | Barmes | D10/91 |
| D542,661 | S * | 5/2007 | Adler | D9/521 |
| 7,550,683 | B2 * | 6/2009 | Daughtry | G01G 19/4146 177/126 |
| D600,581 | S * | 9/2009 | Brown | D10/91 |
| 7,661,533 | B2 * | 2/2010 | Adler | B65D 1/0223 206/459.5 |
| D675,097 | S * | 1/2013 | Burke, Jr. | D9/436 |
| 8,859,914 | B1 * | 10/2014 | Huang | G01G 21/28 177/126 |
| 9,119,501 | B2 * | 9/2015 | Xie | A47J 36/32 |
| 9,361,780 | B2 * | 6/2016 | Burke, Jr. | G06F 19/3462 |
| 2010/0101186 | A1 * | 4/2010 | Cronin | B65D 21/08 53/436 |
| 2013/0269718 | A1 * | 10/2013 | Bardelli | A24F 13/20 131/250 |
| 2014/0202473 | A1 * | 7/2014 | Bardelli | A24F 13/24 131/250 |

(Continued)

*Primary Examiner* — Rakesh Kumar

(57) ABSTRACT

A combination storage container, scale, and rolling paper dispenser having an airtight storage container, a scale, a rolling paper dispenser, a cigarette roller, a magnifying glass, a light, and a lighter. There is a battery compartment having a plurality of batteries which powers the scale and a digital readout for said scale, as well as a light to illuminate the contents of the storage container. An integrated rechargeable battery and a USB charging port power the lighter. The present combination storage container, scale, and rolling paper dispenser is portable and offers a sleek design which incorporates each of the elements into a single cylindrical profile.

4 Claims, 6 Drawing Sheets

(56) References Cited

U.S. PATENT DOCUMENTS

| | | | | |
|---|---|---|---|---|
| 2015/0274401 | A1* | 10/2015 | Mabe | B65D 83/0011 222/1 |
| 2016/0044955 | A1* | 2/2016 | Gerardi | A24B 15/10 206/265 |
| 2016/0106149 | A1* | 4/2016 | Potter | B65D 81/26 206/265 |
| 2016/0122117 | A1* | 5/2016 | Moore | B65D 81/268 206/204 |
| 2017/0022023 | A1* | 1/2017 | Littlejohns | B65H 35/002 |
| 2017/0328694 | A1* | 11/2017 | Keller | F42B 33/06 |
| 2017/0332693 | A1* | 11/2017 | Benford | A24B 15/282 |

* cited by examiner

COMBINATION STORAGE CONTAINER, SCALE, AND ROLLING PAPER DISPENSER

BACKGROUND OF THE INVENTION

Various types of storage containers and scales are known in the prior art. However, most existing storage containers and scales are not integrated, and further lack other elements relevant to the process of storing and rolling loose tobacco. When a user has all of the required elements, he has a full kit and would require a bag to transport them or keep them together. What is needed, and what the present combination storage container, scale, and rolling paper dispenser provides, is a device having an airtight storage container, a scale, a rolling paper dispenser, a cigarette roller, a magnifying glass, a light, and a lighter. The present combination storage container, scale, and rolling paper dispenser is portable and offers a sleek design which incorporates each of the elements into a single cylindrical profile.

FIELD OF THE INVENTION

The present invention relates to containers, and more particularly, to a combination storage container, scale, and rolling paper dispenser.

SUMMARY OF THE INVENTION

The general purpose of the present combination storage container, scale, and rolling paper dispenser, described subsequently in greater detail, is to provide a combination storage container, scale, and rolling paper dispenser that has many novel features that result in a combination storage container, scale, and rolling paper dispenser that is not anticipated, rendered obvious, suggested, or even implied by prior art, either alone or in combination thereof.

To accomplish this, the present combination storage container, scale, and rolling paper dispenser includes a transparent cylindrical enclosure having a top threaded opening having a first threading, a bottom threaded opening having a second threading, and a magnifying glass. The magnifying glass is integrally disposed within the enclosure and is configured to magnify a content of the enclosure for a user. A threaded bottom has a third threading, an underside, an inner surface, and an aperture. The third threading is selectively engageable with the second threading of the bottom threaded opening of the transparent cylindrical enclosure, and the second threading and the third threading form an airtight seal when engaged. The aperture is centrally disposed from the inner surface to the underside. There is a rotatable scraper having a pivot, a knob, and a scraper arm. The pivot is disposed through the aperture of the threaded bottom, with the knob disposed on a first end of the pivot on the underside of the threaded bottom, and the scraper arm disposed on a second end of the pivot proximal the inner surface of the threaded bottom. The rotatable scraper is configured to scrape said inner surface when rotated via the knob on the underside of the threaded bottom, and can be used to remove residue left by a substance stored within the transparent cylindrical enclosure.

A threaded top has a bottom surface, an outer wall, a top cavity, a hinged lid having a closed position and an alternate open position, and a fourth threading. The fourth threading is disposed proximal the bottom surface and is selectively engageable with the first threading of the top threaded opening of the transparent cylindrical enclosure, and the first threading and the fourth threading form an airtight seal when engaged. The hinge of the hinged lid is disposed on the outer wall such that the hinged lid covers the top cavity while in the closed position. A scale is disposed on the bottom surface of the threaded top, such that it can be turned over to measure a weight or a mass of the contents of the transparent cylindrical enclosure. When the threaded top is separate from the transparent cylindrical enclosure, the scale can be used as a traditional scale. A measurement from the scale is displayed on a pop-out digital scale readout which is in operational communication with the scale. The pop-out digital scale readout is disposed within the outer wall of the threaded top, and it has a light, a popped-out position, and an alternate pushed-in position. The light is configured to illuminate the contents of the transparent cylindrical enclosure when the pop-out digital scale readout is in the popped-out position. The pushed-in position puts the pop-out digital scale readout flush with the surface of the outer wall of the threaded top. A battery compartment disposed within the outer wall of the threaded top has a plurality of batteries, and the battery compartment is in operational communication with the scale of the threaded top and the pop-out digital scale readout and provides power to each.

An alternative embodiment of the present combination storage container, scale, and rolling paper includes a pop-out lighter disposed within the outer wall of the threaded top. The pop-out lighter has a second popped-out position and an alternate second pushed-in position. The pushed-in position puts the pop-out lighter flush with the surface of the outer wall of the threaded top. A rechargeable battery is disposed within the threaded top, and a power button is disposed within the outer wall of the threaded top. The rechargeable battery and the power button are each in operational communication with the pop-out lighter. A USB adaptor disposed within the outer wall of the threaded top is in operational communication with the rechargeable battery and is used to charge said rechargeable battery.

An additional optional embodiment of the present storage container, scale, and rolling paper dispenser further includes a rolling paper dispenser disposed within the outer wall of the threaded top. A cigarette roller may also be disposed within the cavity of the threaded top.

Thus have been broadly outlined the more important features of the present combination storage container, scale, and rolling paper dispenser so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
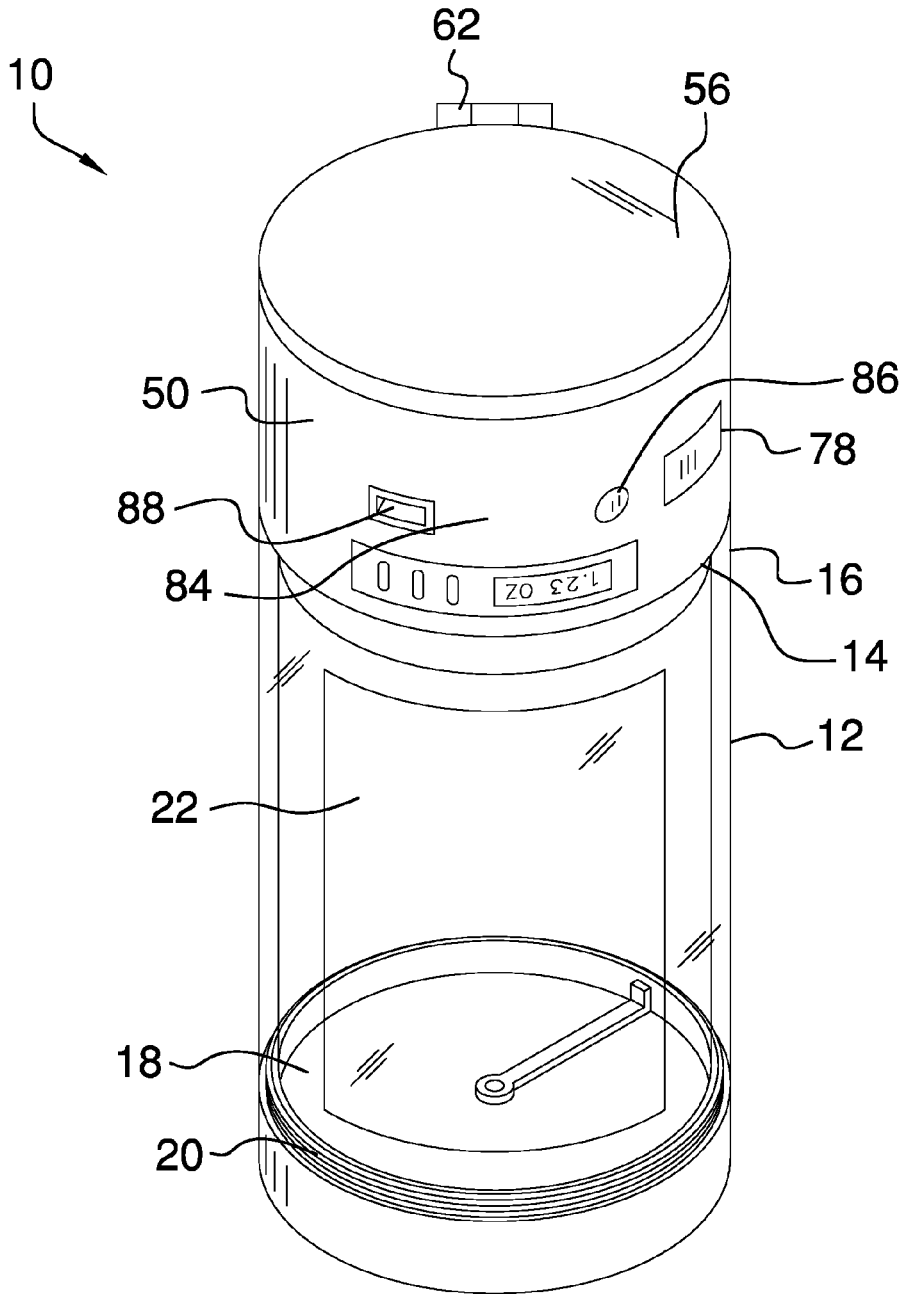
FIG. 1 is an isometric view of a combination storage container, scale, and rolling paper dispenser.
Figure 2:
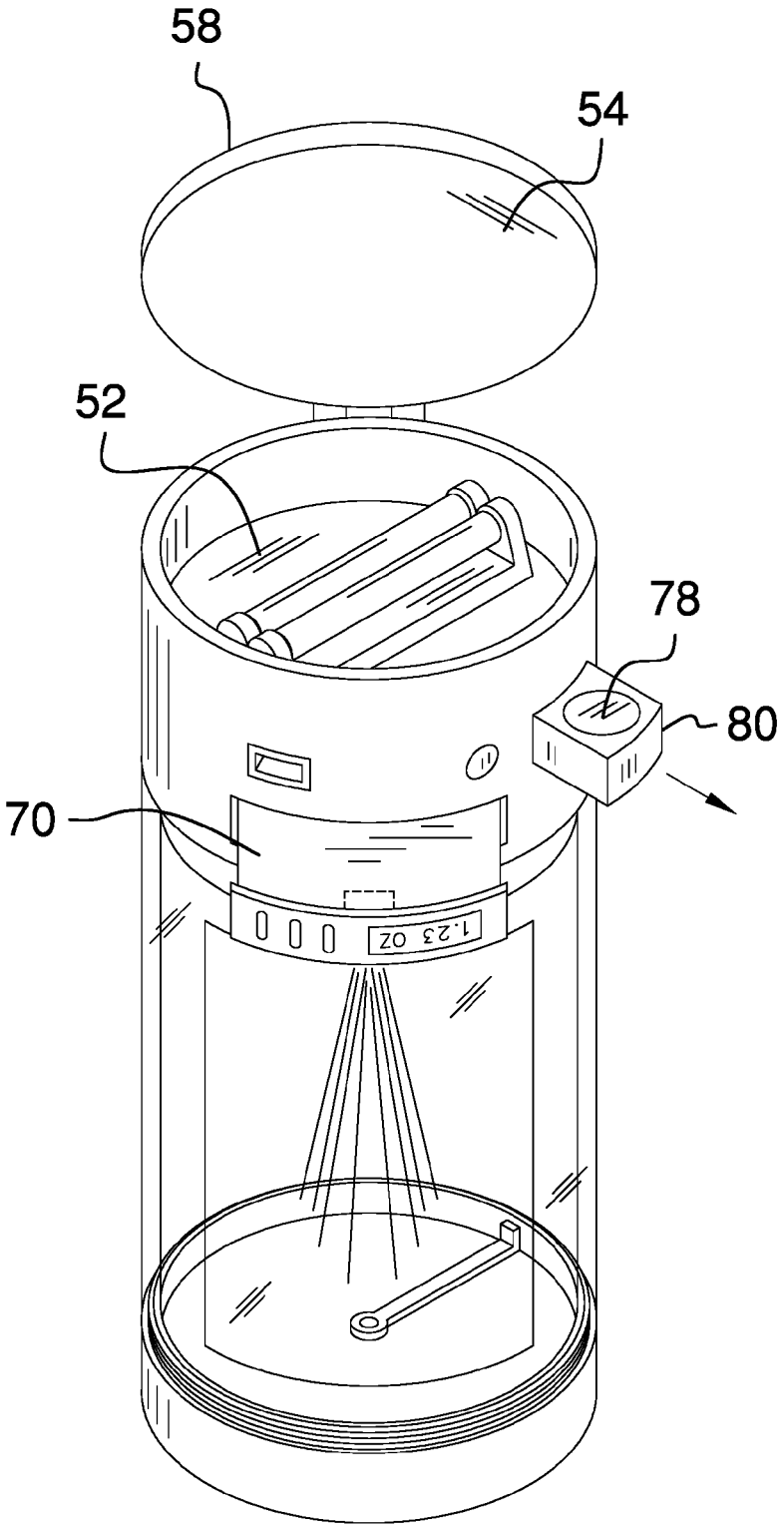
FIG. 2 is an isometric view of the combination storage container, scale, and rolling paper dispenser showing an open top cavity.
Figure 3:
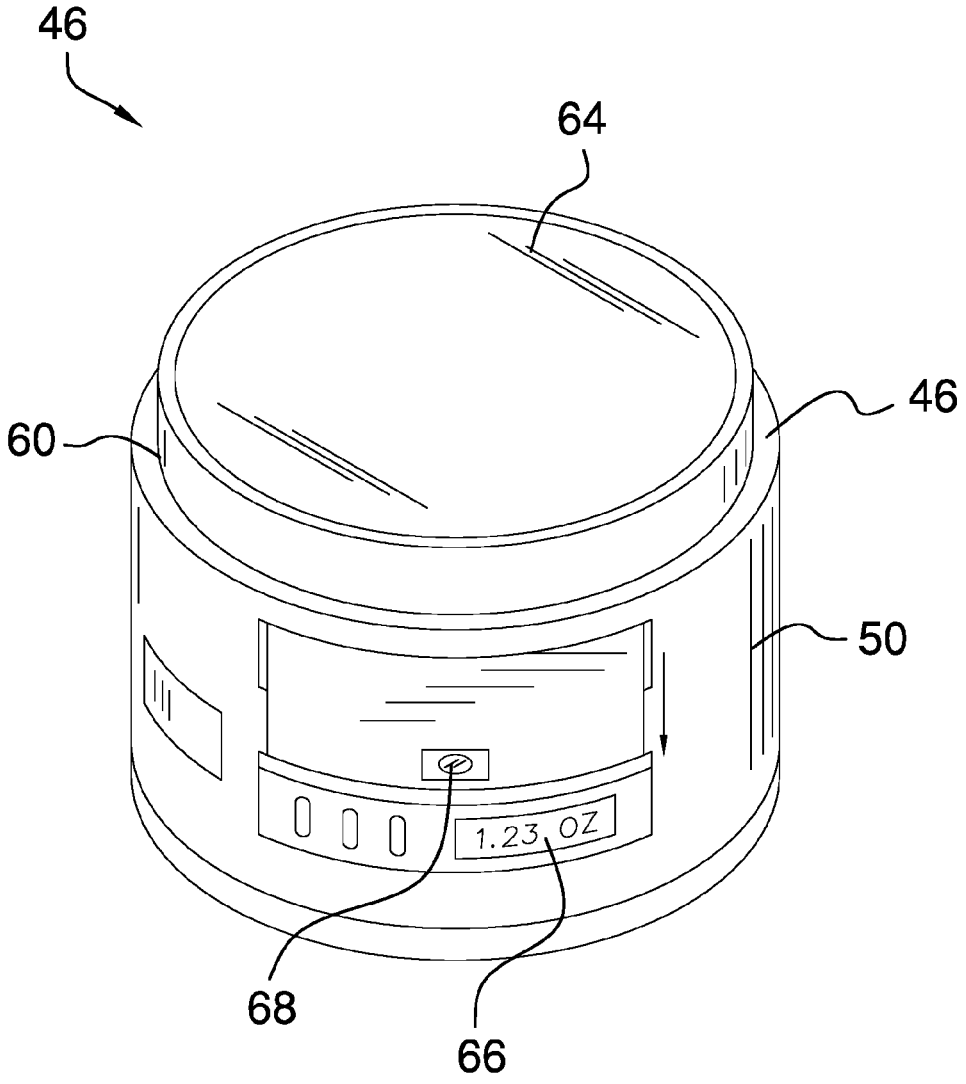
FIG. 3 is an isometric view of a top of the combination storage container, scale, and rolling paper dispenser.
Figure 4:
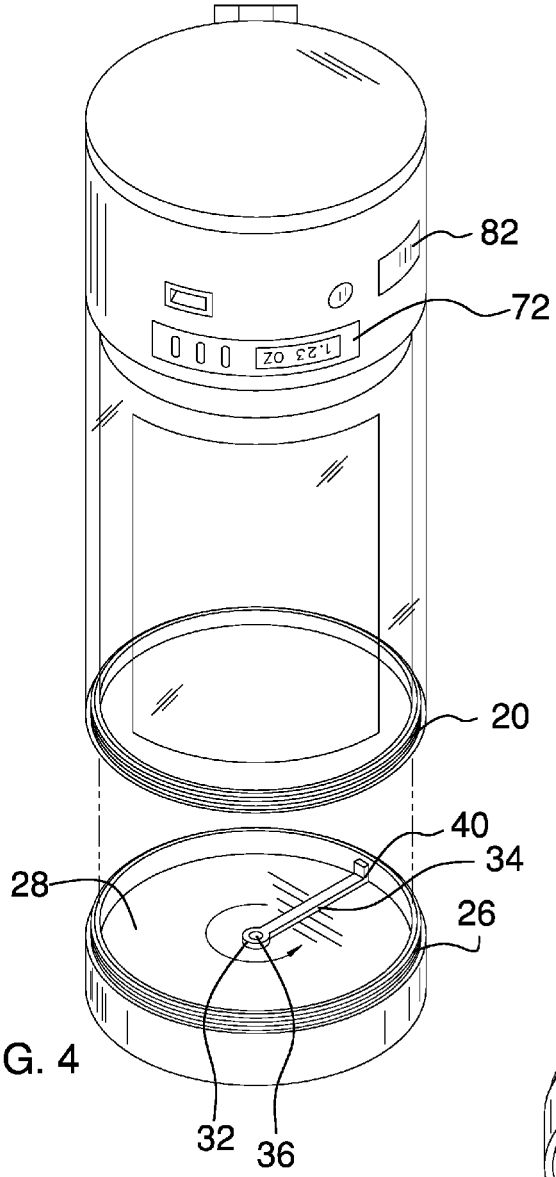
FIG. 4 is an isometric exploded view showing a threaded bottom of the combination storage container, scale, and rolling paper dispenser.
Figure 5:
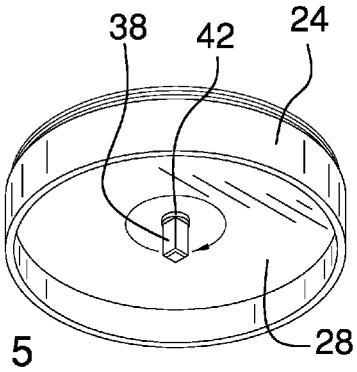
FIG. 5 is an isometric view of the threaded bottom of the combination storage container, scale, and rolling paper dispenser.
Figure 6:
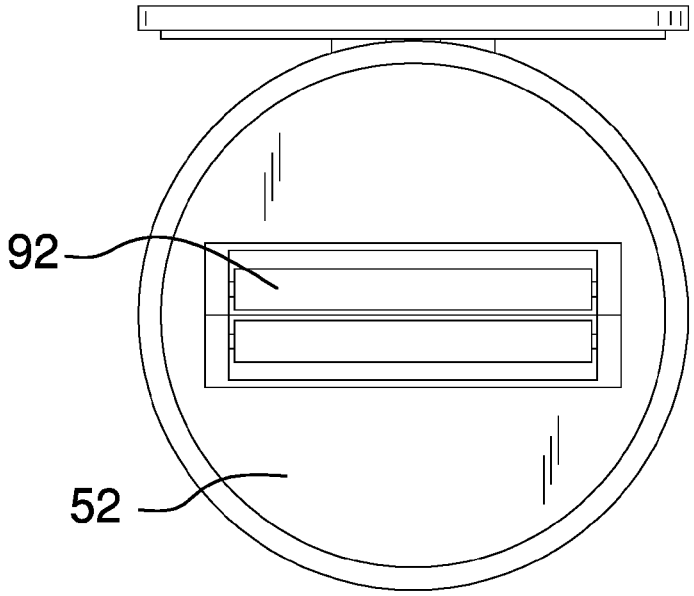
FIG. 6 is a top plan view of the combination storage container, scale, and rolling paper dispenser.
Figure 7:
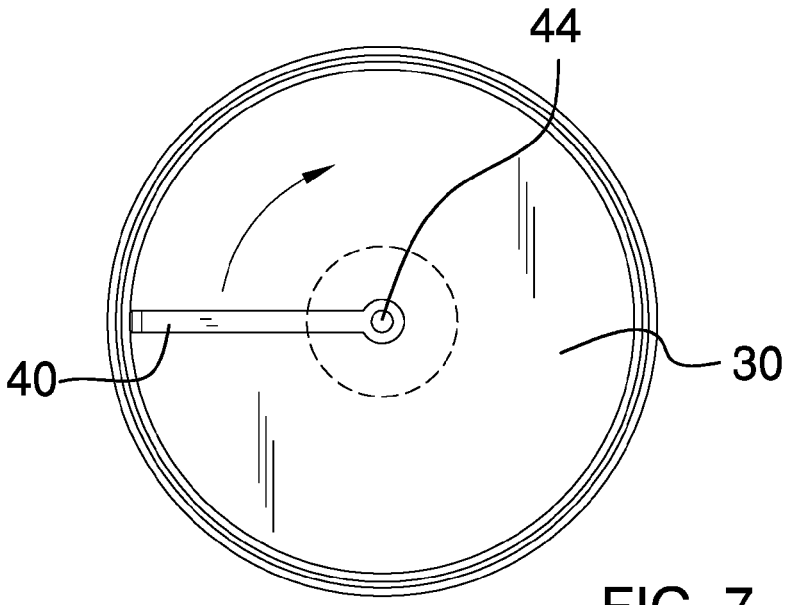
FIG. 7 is a top plan view of the threaded bottom of the combination storage container, scale, and rolling paper dispenser.
Figure 8:
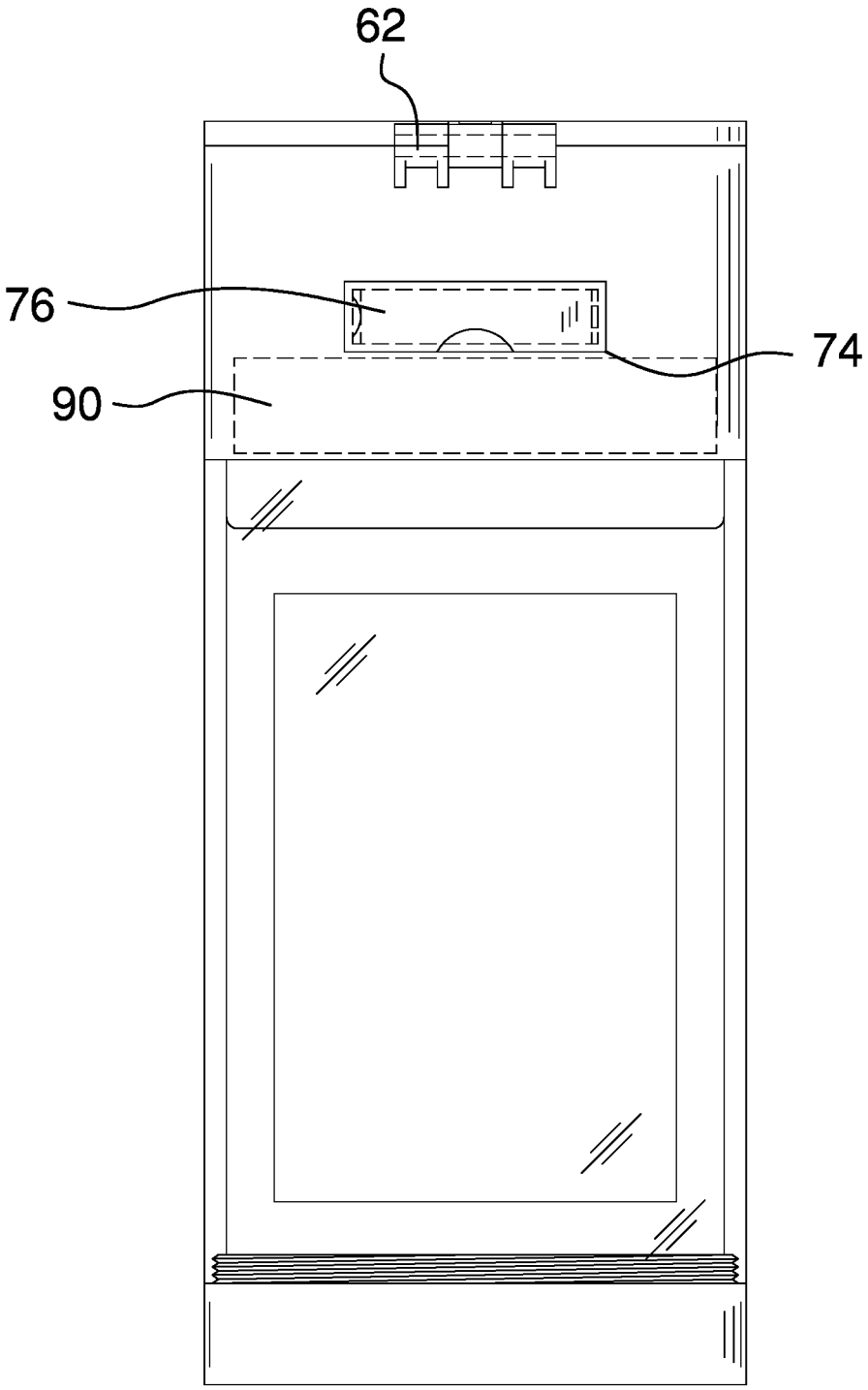
FIG. 8 is a rear elevation view of the combination storage container, scale, and rolling paper dispenser.

With reference now to the drawings, and in particular FIGS. 1 through 8 thereof, an example of the instant combination storage container, scale, and rolling paper dispenser employing the principles and concepts of the present combination storage container, scale, and rolling paper dispenser and generally designated by the reference number 10 will be described.

Referring to FIGS. 1 through 8 the present the combination storage container, scale, and rolling paper dispenser 10 is illustrated. The combination storage container, scale, and rolling paper dispenser 10 includes a transparent cylindrical enclosure 12 having a top threaded opening 14 having a first threading 16, a bottom threaded opening 18 having a second threading 20, and a magnifying glass 22. The magnifying glass 22 is integrally disposed within the enclosure 12 and is configured to magnify a content of the enclosure for a user. A threaded bottom 24 has a third threading 26, an underside 28, an inner surface 30, and an aperture 32. The third threading 26 is selectively engageable with the second threading 20 of the bottom threaded opening of the transparent cylindrical enclosure, and the second threading and the third threading form an airtight seal when engaged. The aperture 32 is centrally disposed from the inner surface 30 to the underside 28. There is a rotatable scraper 34 having a pivot 36, a knob 38, and a scraper arm 40. The pivot 36 is disposed through the aperture 32 of the threaded bottom, with the knob 38 disposed on a first end 42 of the pivot on the underside 28 of the threaded bottom, and the scraper arm 40 disposed on a second end 44 of the pivot proximal the inner surface 30 of the threaded bottom.

A threaded top 46 has a bottom surface 48, an outer wall 50, a top cavity 52, a hinged lid 54 having a closed position 56 and an alternate open position 58, and a fourth threading 60. The fourth threading is disposed proximal the bottom surface 48 and is selectively engageable with the first threading 16 of the top threaded opening of the transparent cylindrical enclosure, and the first threading and the fourth threading form an airtight seal when engaged. A hinge 62 of the hinged lid is disposed on the outer wall 50 such that the hinged lid covers the top cavity 52 while in the closed position 56. A scale 64 is disposed on the bottom surface 48 of the threaded top, such that it can be turned over to measure a weight or a mass of the contents of the transparent cylindrical enclosure 12. When the threaded top is separate from the transparent cylindrical enclosure, the scale can be used as a traditional scale. A measurement from the scale 64 is displayed on a pop-out digital scale readout 66 which is in operational communication with the scale. The pop-out digital scale readout is disposed within the outer wall 50 of the threaded top, and it has a light 68, a popped-out position 70, and an alternate pushed-in position 72. The light 68 is configured to illuminate the contents of the transparent cylindrical enclosure when the pop-out digital scale readout is in the popped-out position 70. The pushed-in position 72 puts the pop-out digital scale readout flush with the surface of the outer wall of the threaded top. A battery compartment 74 disposed within the outer wall 50 of the threaded top has a plurality of batteries 76, wherein the battery compartment is in operational communication with the scale 64 of the threaded top and the pop-out digital scale readout 66 and provides power to each.

An alternative embodiment of the present combination storage container, scale, and rolling paper 10 includes a pop-out lighter 78 disposed within the outer wall of the threaded top. The pop-out lighter has a second popped-out position 80 and an alternate second pushed-in position 82. The pushed-in position puts the pop-out lighter flush with the surface of the outer wall of the threaded top. A rechargeable battery 84 is disposed within the threaded top, and a power button 86 is disposed within the outer wall of the threaded top. The rechargeable battery and the power button are each in operational communication with the pop-out lighter. A USB adaptor 88 disposed within the outer wall 50 of the threaded top is in operational communication with the rechargeable battery 84 and is used to charge said rechargeable battery.

An additional optional embodiment of the present storage container, scale, and rolling paper dispenser further includes a rolling paper dispenser 90 disposed within the outer wall of the threaded top. A cigarette roller 92 may also be disposed within the cavity of the threaded top.

What is claimed is:

1. A combination storage container, scale, and rolling paper dispenser comprising:

a transparent cylindrical enclosure having a top threaded opening having a first threading, a bottom threaded opening having a second threading, and a magnifying glass, wherein the magnifying glass is integrally disposed within the enclosure and is configured to magnify a content of the enclosure for a user;

a threaded bottom having a third threading, an underside, an inner surface, and an aperture, wherein the third threading is selectively engageable with the second threading of the bottom threaded opening of the transparent cylindrical enclosure, wherein the second threading and the third threading form an airtight seal when engaged, wherein the aperture is centrally disposed from the inner surface to the underside;

a rotatable scraper having a pivot, a knob, and a scraper arm, wherein the pivot is disposed through the aperture of the threaded bottom, wherein the knob is disposed on a first end of the pivot on the underside of the threaded bottom, wherein the scraper arm is disposed on a second end of the pivot proximal the inner surface of the threaded bottom, and is configured to scrape said inner surface when rotated;

a threaded top having a bottom surface, an outer wall, a top cavity, a hinged lid having a closed position and an alternate open position, and a fourth threading, wherein the fourth threading is disposed proximal the bottom surface and is selectively engageable with the first threading of the top threaded opening of the transparent cylindrical enclosure, wherein the first threading and the fourth threading form an airtight seal when engaged, wherein a hinge of the hinged lid is disposed on the outer wall such that the hinged lid covers the top cavity while in the closed position;

a scale disposed on the bottom surface of the threaded top;

a pop-out digital scale readout, wherein the pop-out digital scale readout is disposed within the outer wall of the threaded top, wherein the pop-out scale digital readout has a light, a popped-out position, and an alternate pushed-in position, wherein the pop-out digital scale readout is in operational communication with the scale, wherein the light is configured to illuminate the contents of the transparent cylindrical enclosure when the pop-out digital scale readout is in the popped-out position; and a battery compartment disposed within the outer wall of the threaded top, wherein the battery compartment has a plurality of batteries, wherein the battery compartment is in operational communication with the scale of the threaded top and the pop-out digital scale readout.

2. The combination storage container, scale, and rolling paper dispenser of claim 1 further comprising:

a pop-out lighter, wherein the pop-out lighter is disposed within the outer wall of the threaded top, wherein the pop-out lighter has a second popped-out position and an alternate second pushed-in position;

a rechargeable battery disposed within the threaded top, wherein the rechargeable battery is in operational communication with the pop-out lighter;

a power button disposed within the outer wall of the threaded top, wherein the power button is in operational communication with the pop-out lighter; and a USB adaptor disposed within the outer wall of the threaded top, wherein the USB adaptor is in operational communication with the rechargeable battery.

3. The combination storage container, scale, and rolling paper dispenser of claim 2 further comprising a cigarette roller disposed within the cavity of the threaded top.

4. The combination storage container, scale, and rolling paper dispenser of claim 3 further comprising a rolling paper dispenser disposed within the outer wall of the threaded top.

* * * * *